US006003915A

United States Patent [19]

Bierman

[11] Patent Number: 6,003,915

[45] Date of Patent: Dec. 21, 1999

[54] AVALANCHE SHOVEL

[76] Inventor: Paul Douglas Bierman, P.O. Box 7163, Bozeman, Mont. 59715

[21] Appl. No.: 08/533,619

[22] Filed: Sep. 25, 1995

[51] Int. Cl.[6] ..... E01H 5/02; A63C 11/22

[52] U.S. Cl. ..... 294/51; 294/24; 294/57; 280/823

[58] Field of Search ..... 294/24, 51, 57, 294/58, 61, 54.5; 280/813, 816, 819, 823; 7/116, 167; 30/164.5, 164.7

[56] References Cited

U.S. PATENT DOCUMENTS

| | | | |
|---|---|---|---|
| 160,170 | 2/1875 | Cunningham | 294/57 |
| 634,696 | 10/1899 | Michie | 7/116 |
| 884,177 | 4/1908 | Lowry | 294/51 |
| 1,380,090 | 5/1921 | Williams | 294/57 |
| 3,712,652 | 1/1973 | Uilkema | 280/823 |
| 4,145,063 | 3/1979 | Knapp et al. | 280/813 |
| 4,288,102 | 9/1981 | Ramer | 280/823 |
| 4,402,529 | 9/1983 | Cavazza | 280/816 |

FOREIGN PATENT DOCUMENTS

| | | | |
|---|---|---|---|
| 667608 | 11/1938 | Germany | 294/57 |

*Primary Examiner*—Dean Kramer

[57] ABSTRACT

An improved snow shovel with a telescoping handle comprised of a plurality of tubular elements, the outermost element having a grip at one end and the innermost element having a tip at the opposite end; a detaching blade, and a permanently mountable secondary tip and manually mounting removable basket. With the blade removed, the handle telescopes to a length greater than seven feet thus converting into a singular rod or snow probe used to feel or probe for buried victims in avalanche debris. When the handle is retracted, the blade is attached and the outermost telescoping element extends outwardly to a locked position. This increases leverage when digging to recover avalanche victims. With the blade detached and the handle extended, the secondary tip secures to the primary tip on the innermost element. This allows the snow basket to be mounted. The handle is then adjustable to any one of several positions for use as a spare ski pole when necessary. When the snow basket is removed and the handle is retracted fully, the individual elements of the shovel handle interlock within each other so that the shovel handle remains in a locked position. In this manner, the handle and blade are small enough to be carried into the back country by either skiers, snow shoers, or snowmobilers. Thus, the Extreme Avalanche Shovel offers winter enthusiasts a more effective and efficient recovery technique for saving lives of avalanche victims than current procedures offer.

13 Claims, 9 Drawing Sheets

CROSS SECTION

AVALANCHE SHOVEL

BACKGROUND OF THE INVENTION

The background of the invention is presented in two parts: (1) the field of the invention, and (2) a description of the prior art.

1. Field of Invention

This invention relates to sporting goods, and particularly to avalanche shovels, snow probes, ski poles and other safety equipment carried during back-country travel in the winter season.

2. Description of Prior Art

In the past, various efforts have been made to provide collapsible snow shovels, shovel handles, and telescoping ski poles that require less storage space when not in use. Generally, these shovels and shovel handles are designed without weight being a factor, thus resulting in a heavy or bulky product. The need to incorporate a snow probe, a snow shovel, and an adjustable ski pole into one apparatus did not exist until recently because travel in the back country has been very limited. Today, with technologically advanced snowmobiles and back country ski equipment, back country travel is rapidly becoming a favorite winter sport. Consequently, more snowmobilers and skiers are increasingly involved with avalanches and the death tolls continue to climb each year. One problem with the prior art is that it is not suitable or customized enough to be accepted as life-saving tools by today's snowmobilers and back country skiers. U.S. Pat. No. 808,992 to Lawson discloses an extensible handle for shovels and the like; however, because of its solid, multiple interlocking sections, it is too heavy and too bulky, thus making it difficult to pack. In addition, because of the solid design, it is not feasible to incorporate other necessary tools inside the handle of Lawson's invention. U.S. Pat. No. 1,267,915 to Shellabarger discloses another type of handle for shovels which incorporates longitudinally extending grooves within telescoping elements. This method is prohibitively expensive to manufacture and results in a shovel that is not cost effective to produce. Secondly, Shellabarger's shovel was not designed with weight in mind and is merely an extending shovel handle permanently secured to a shovel blade. This increases the difficulty of packing such an apparatus. Furthermore, an adjustable ski pole and snow probe cannot be incorporated into Shellabarger's invention, further limiting its effectiveness and denying it any other uses than a shovel. U.S. Pat. No. 2,085,382 to Nebor discloses another type of collapsible snow shovel designed to be stored in an automobile trunk or tool box. The blade of this shovel, made of corrugated sheet metal is too heavy. In addition, its construction relies on dually slidable corrugated sheet metal sections. This severely detracts from its simplicity and adds to its production cost.

U.S. design Pat. No. 267,468 to Simms most closely relates to the invention of the Extreme Avalanche Shovel; however, Simms' shovel is limited in its usefulness because it fails to incorporate a snow probe and ski pole into the same apparatus. Simms' shovel is an effective back country shovel, but its use requires a separate snow probe be carried into the field, which adds to the bulk and weight one must pack. It also lacks means for converting it into a ski pole. U.S. Pat. No. 4,424,987 to Ryder discloses a collapsible ski pole. Firstly, the basket cannot be detracted from this ski pole, thus preventing it from being used as a snow probe. Secondly, it is too short to be an effective snow probe. Thirdly, it has no means of attaching a shovel blade so it can be dually utilized as a shovel handle.

Therefore, all the devices heretofore known suffer from a number of disadvantages:

(a) the scope of the above mentioned devices is solely focused on a single function;

(b) with the exception of the device disclosed in U.S. design Pat. No. 267,468 to Simms, all previously noted devices were designed for users other than the skiers or snowmobilers as they are overly heavy, bulky and difficult to pack; and (c) the use of any of these above-mentioned devices in the field would require the user to carry in addition to these devices, complimentary equipment compensating for the lack of function of these apparatuses. This inconvenience adds to the bulk and weight one must carry in the back country. The mere thought of this additional weight may deter back country enthusiasts from carrying any or all of the aforementioned gear which may leave them unprepared during travel. Consequently, unproper preparation may result in injury or death. This has been documented from instances in the past.

SUMMARY OF THE INVENTION

The present invention provides a multi-function tool for back-country travelers. A light-weight and compact design allows a vary of functions to be supported. With the invention of the Extreme Back Country Shovel, one tool is now sufficient for snowmobilers and skiers to carry, for it is designed with the needs of these users specifically in mind.

Several objects and advantages of the Extreme Back Country Shovel are:

(a) to provide a compact and lihtweight tool with a number of functions;

(b) to provide a snow probe within a shovel to aid in locating buried victims of avalanches more efficiently as time is a crucial factor when saving the lives of victims buried by avalanches;

(c) to provide the use of an extendible ski pole with virtually no extra weight or space required in the event that one is necessary;

(d) ultimately, to provide means for increasing the odds of staying alive during back country travel in the winter season.

REFERENCE NUMERALS IN DRAWINGS

Figure 1:
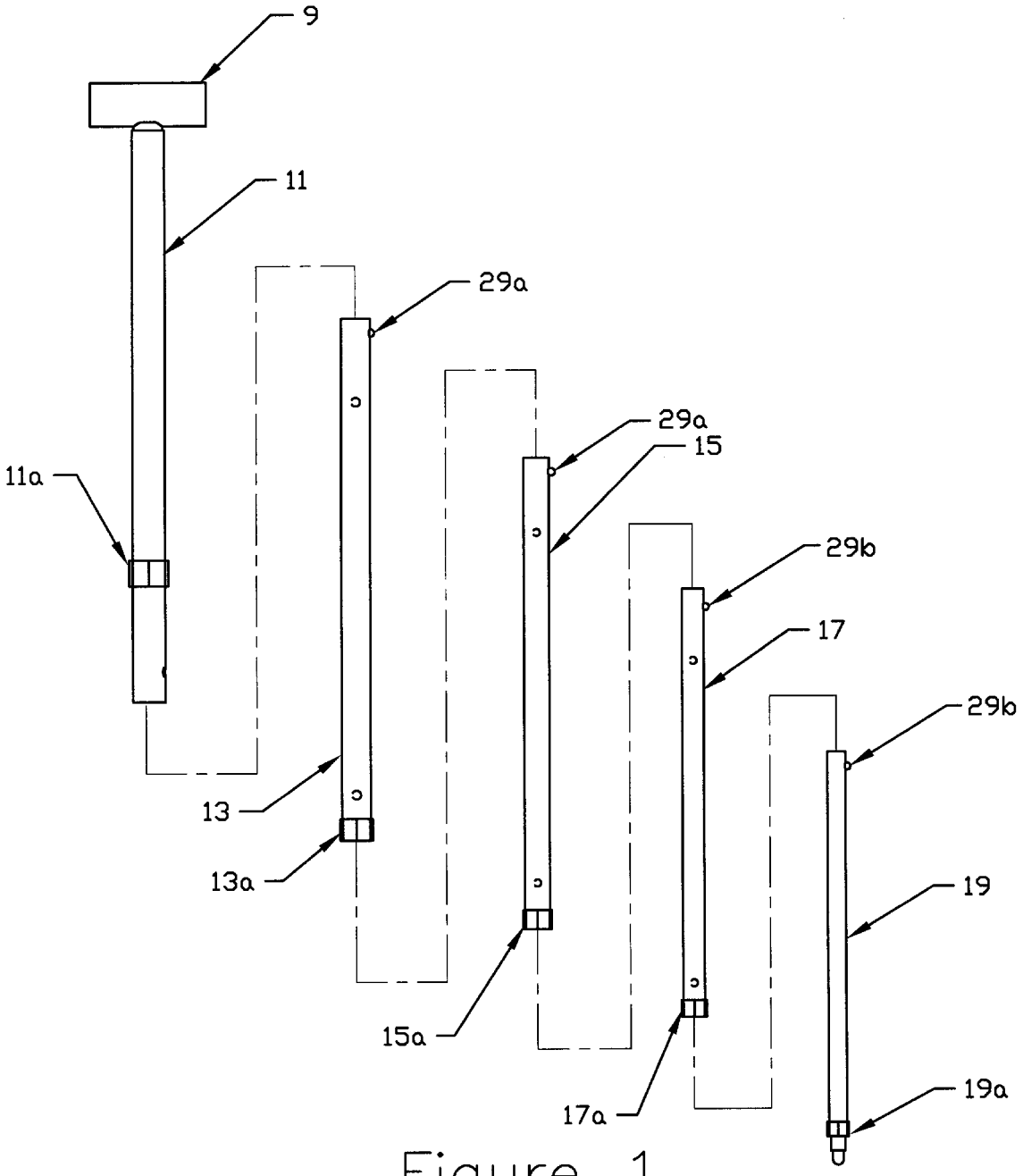
FIG. 1 is an exploded view of the plurality of elements interconnected to provide a telescoping shovel handle, adjustable ski pole and snow probe.
Figure 2:
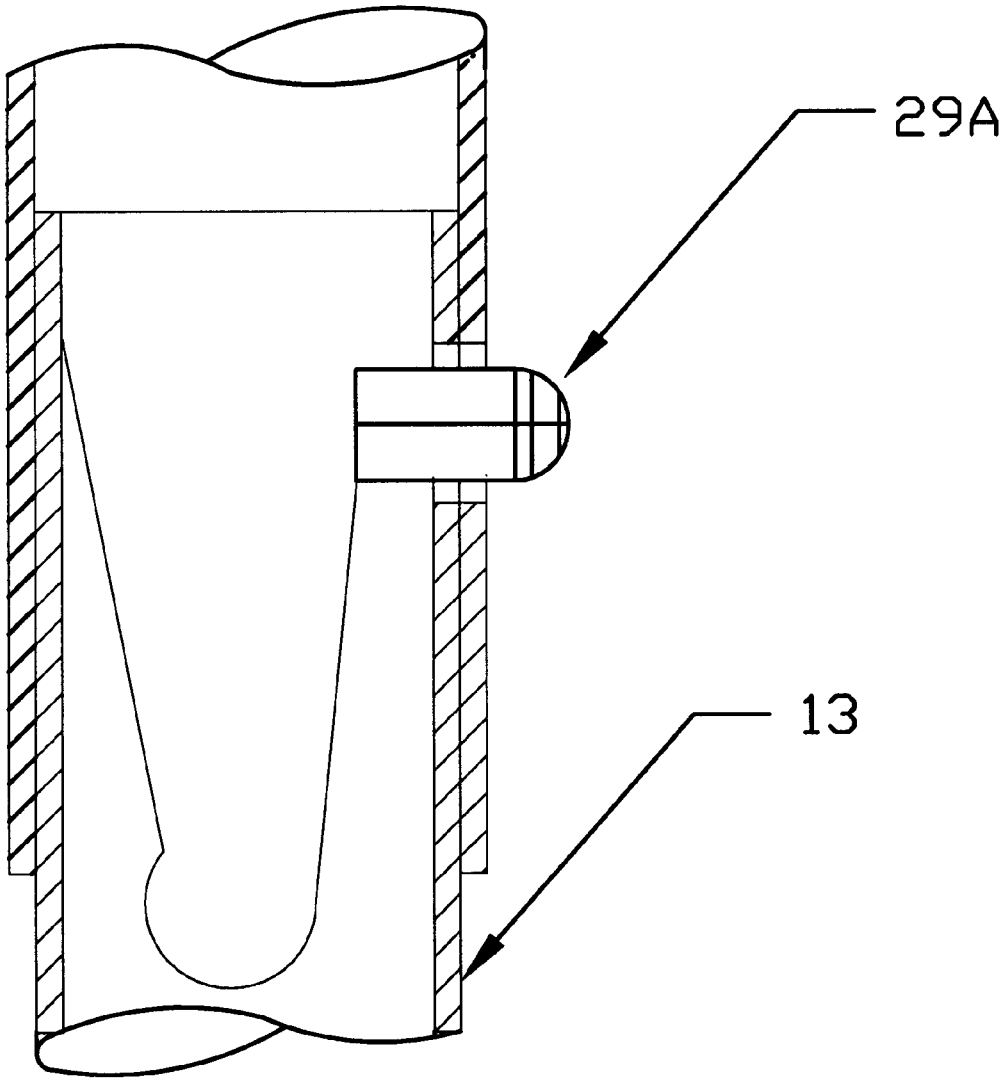
FIG. 2 is a cross-sectional view of a tubular element illustrating a locking spring pin within the element.

7 blade
8 aperture in element 11
9 grip
9*a* removable wrist strap
11 outermost element of telescoping handle
13 secondmost outer element
14 aperture common to elements 13, 15, 17, and 19
15 thirdmost outer element
16 aperture in element 11
17 secondmost inner element
18 aperture nearest spring pin 29*c* in element 17
19 innermost element
21 primary tip
22 telescoping handle collectively comprised of elements 11, 13, 15, 17, and 19
23 spring pin attached to blade 7
25 secondary ski pole tip with threaded finish to attach to snow basket 27
26 female threaded hole in snow basket 27
27 snow basket
29*a*, 29*b*, 29*c*, 29*d* spring pins

DESCRIPTION OF THE PREFERRED EMBODIMENTS

A preferred embodiment of the present invention is illustrated in exploded form in FIG. 1. Element 19 is the innermost tubular element with primary tip 21 attached and extending beyond the end of element 19. Collet 19*a* is attached to the bottom of element 19, above the primary tip 21. Element 19 has spring pin 29*d* secured inside, on the end opposite to which collet 19*a* is attached. Element 19 has a smaller outside diameter than the inside diameter of element 17 allowing element 19 to telescope inside element 17.

Element 17 is the second most inner element of the telescoping handle. Collet 17*a* is attached to the end of element 17 which receives element 19. Inside the other end of element 17 is secured spring pin 29*c*. In addition, element 17 has numerous transversely located apertures offset (eg., by 90 degrees) from the orientation of spring pin 29*c*.

Element 15 is constructed in the same manner as element 17, the only variation being its larger diameter and over all length. Element 17 fits inside element 15.

Element 13 is constructed in a similar fashion to element 17 with the stipulations that it does not have a collet and it is of larger diameter and longer length than elements 15, 17, and 19 respectively. Element 15 fits inside element 13.

Element 11 is the outermost element of the telescoping handle with hand grip 9 attached at one end. Element 11 has two apertures, aperture 8 near hand grip 9 and aperture 16 near opposite end 10. Element 13 fits inside element 11.

Figure 3:
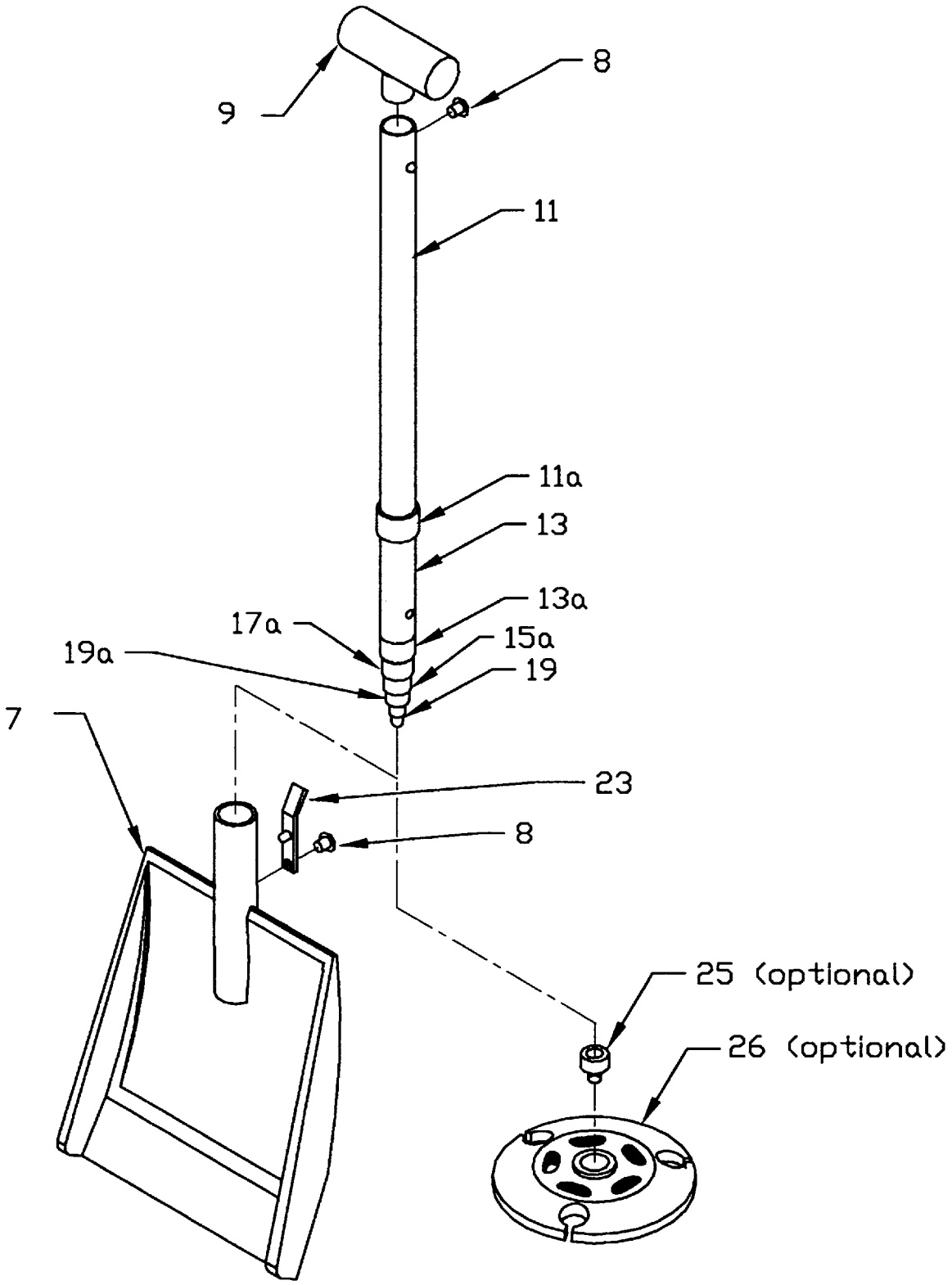
FIG. 3 shows the plurality of elements fully collapsed and indexed within each other with blade 7 removed.

FIG. 3 illustrates the handle in its fully collapsed form without blade 7 attached. Element 19 collapses inside element 17. Its collapsible length is limited by collet 19*a*. Conversely, when collapsed to its minimum length, spring pin 29*d* of element 19*a* locks into topmost aperture 18 of element 17 to lock or index element 19 to element 17. Tubular elements 17, 15, 13, and 11 all collapse and lock inside each other in the same fashion as elements 17 and 19.

Figure 4:
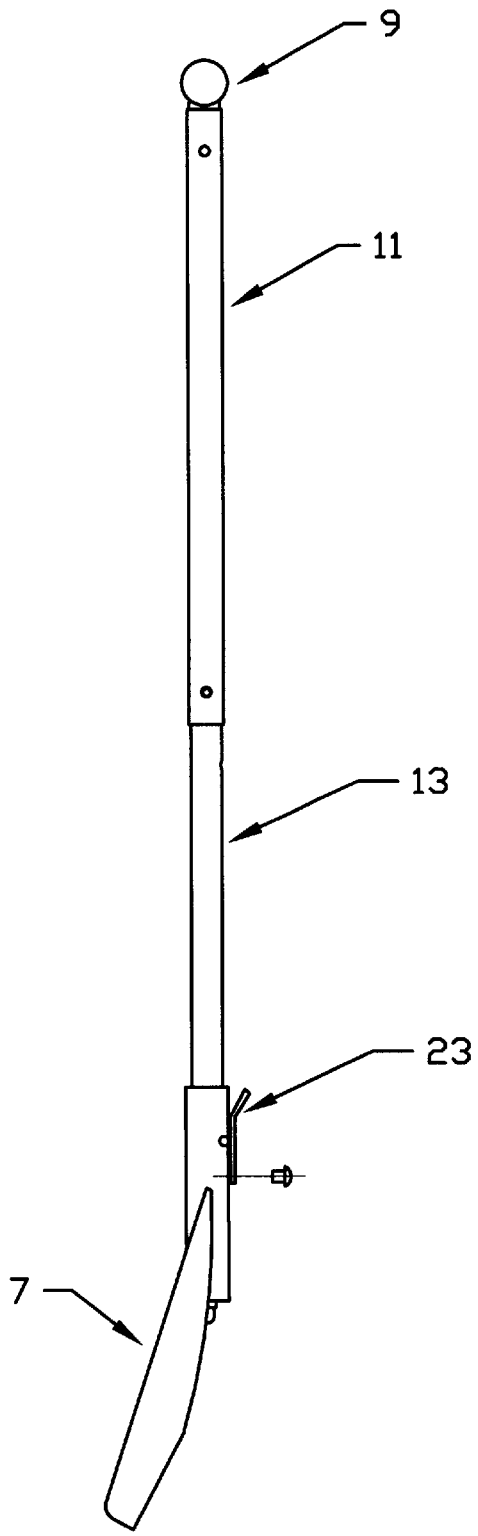
FIG. 4 shows a side view of the Extreme Avalanche Shovel with spring pin 23 fastened to blade 7.
Figure 5:
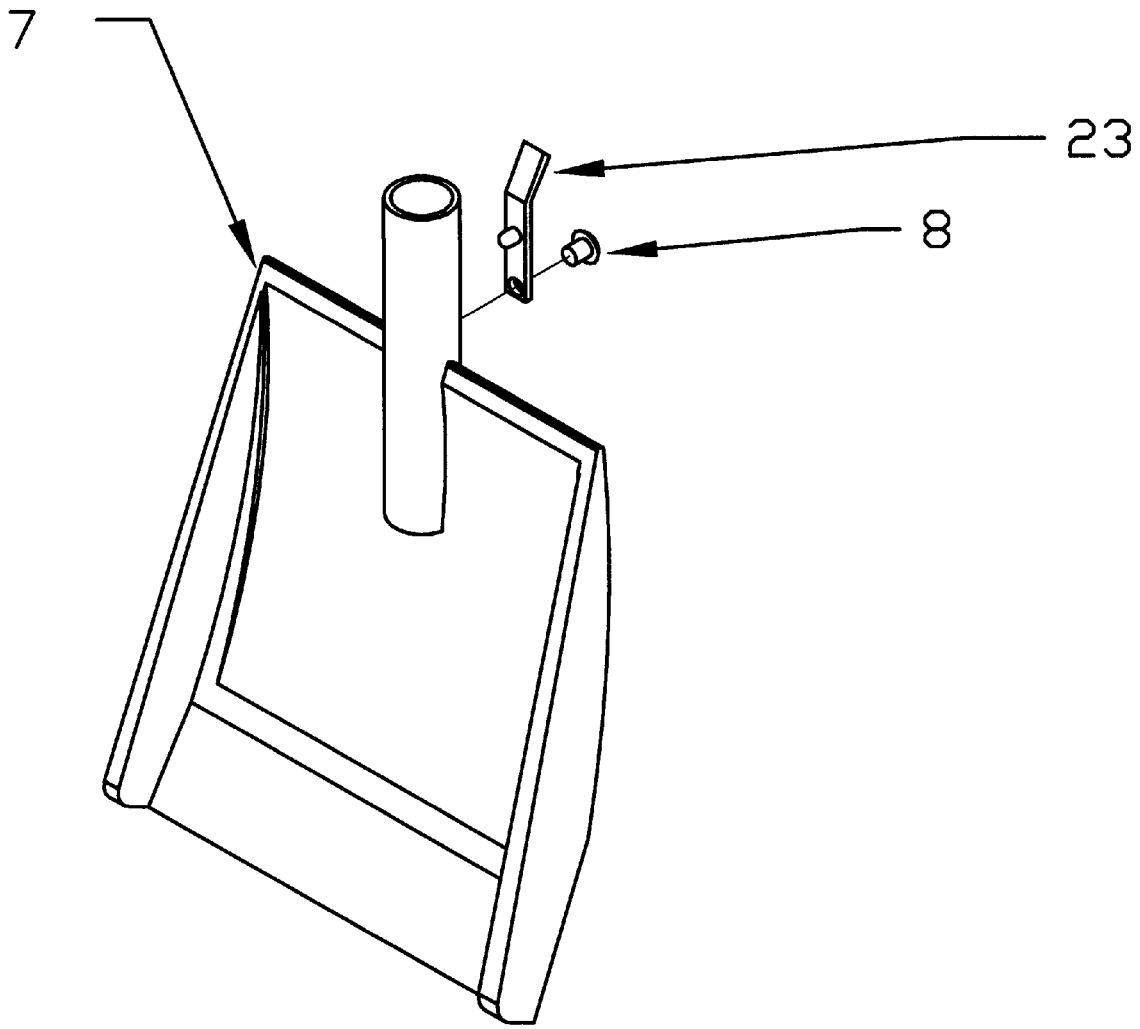
FIG. 5 shows a side view of the locking spring pin mounted to the shovel blade 7 for means of securing the handle to the blade.

When all elements are collapsed and locked or indexed within each other, apertures 14; common to elements 13, 15, 17, and 19 align as indicated in FIG. 3. Alignment of these apertures allows spring pin 23 of blade 7 to positively lock on to the handle (FIG. 4).

In the embodiment shown in FIG. 3, secondary tip 25 is a ski pole tip that is permanently mountable on primary tip 21. Secondary tip 25 has a male threaded finish for accepting the female threaded hole 26 in snow basket 27 when using the handle as an adjustable ski pole. With the secondary tip 25 fastened to the primary tip 21, the function of the snow shovel and snow probe is not hindered by any means, way, shape or form; thus, it can be permanently fastened to the primary tip.

When blade 7 attaches to handle 22, the blade butts up to element 11. Thus, everything below line 12 of FIG. 3 is nested within the cavity of the blade.

Figure 6:
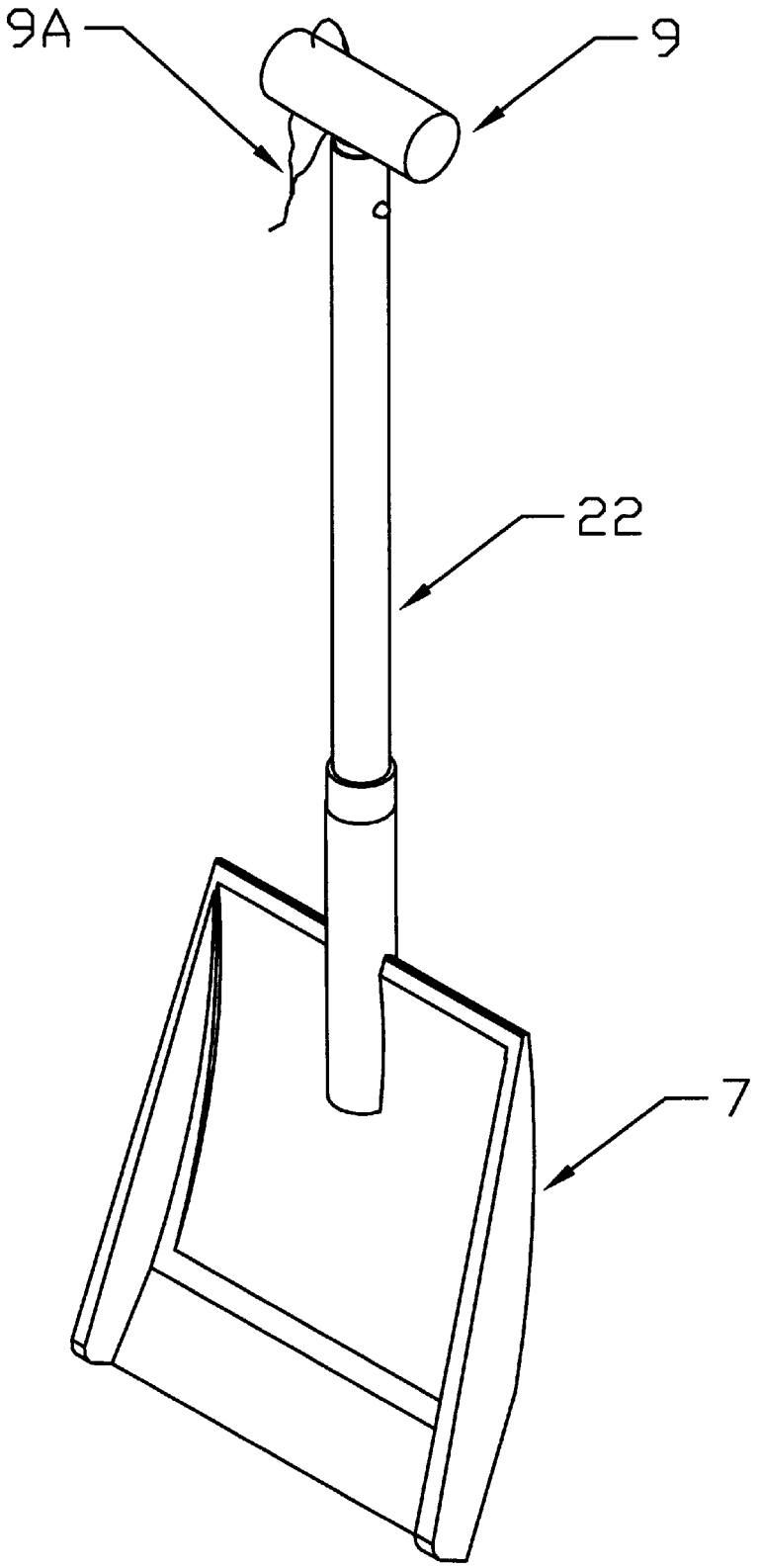
FIG. 6 shows a front view of the Extreme Avalanche Shovel with the handle 22 locked in a fully collapsed position and blade 7 attached.
Figure 7:
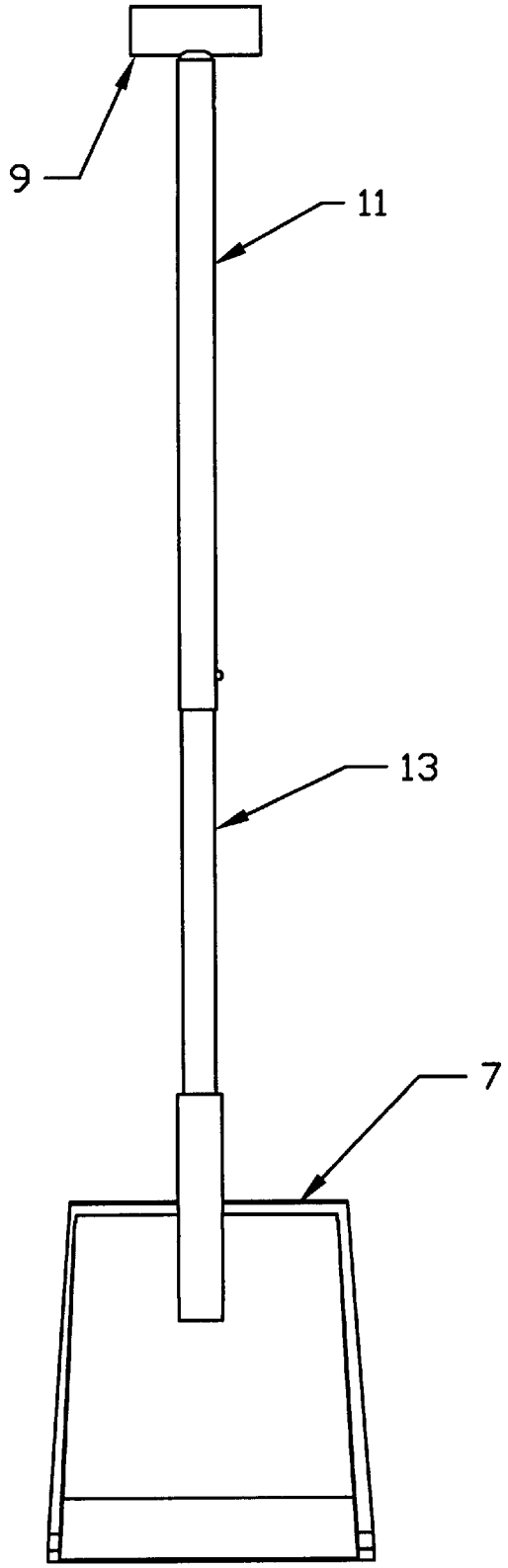
FIG. 7 illustrates the telescoping capacity of the Extreme Avalanche Shovel with the blade 7 attached.

The manner of using the Extreme Avalanche Shovel is relatively simple. When in its collapsed form illustrated by FIG. 6, one simply depresses spring pin 29*a* protruding outward near grip 9. This allows outer element 11 to extend until aperture 16 lines up with spring pin 29*a*. When this happens, the handle is locked into an extended position to increase leverage while digging for victims.

Figure 8:
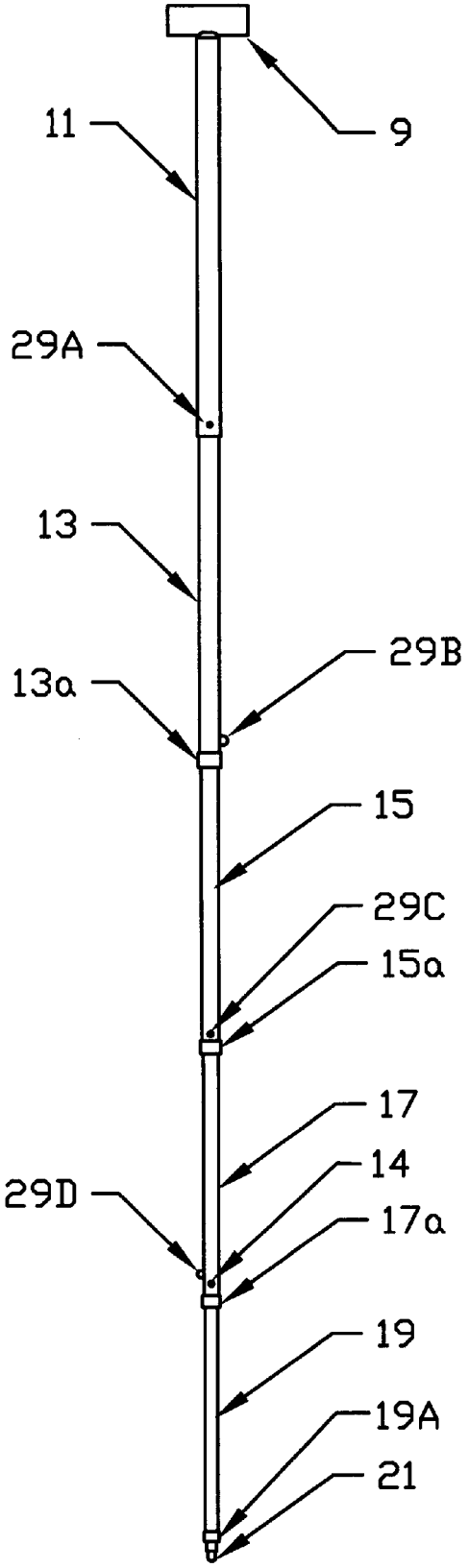
FIG. 8 illustrates the outwardly telescoping capacity of the handle (elements 11, 13, 15, 17, and 19) when use is as a snow probe.
Figure 8A:
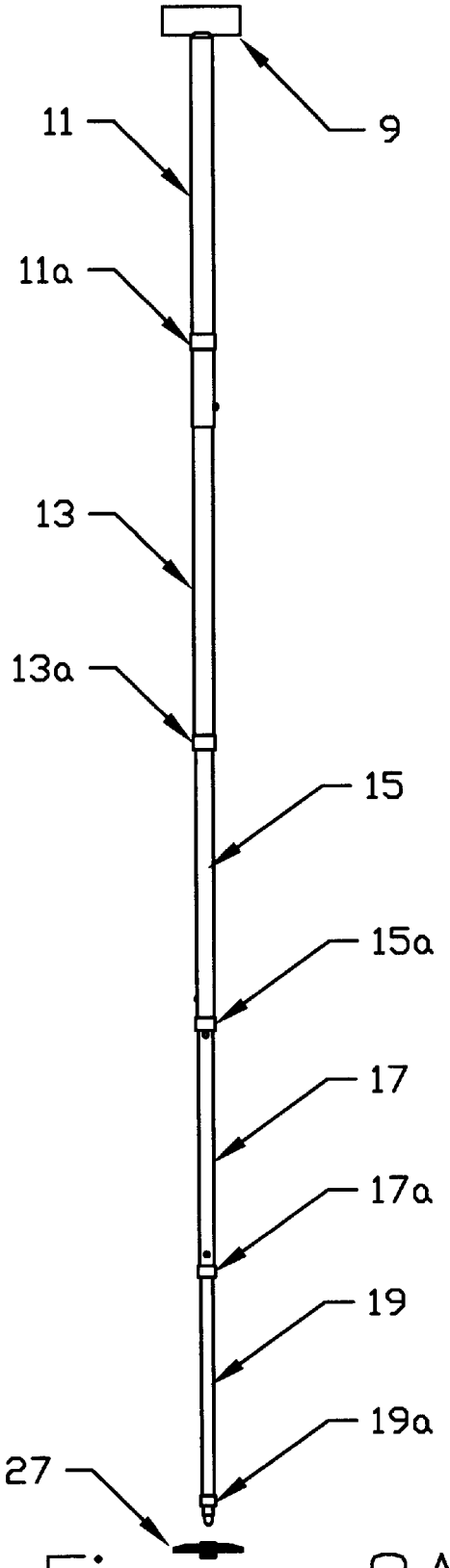
FIG. 8*a* shows the apparatus with secondary tip 25 and snow basket 27 attached. The telescoping handle is shown locked in a given adjusted length.

By lifting the tab of spring pin 23 (FIG. 4), blade 7 is removable from handle 22, and elements 13, 15, 17, 19 are exposed. These elements can be telescoped starting with the largest diameter element and working down to the smallest diameter element. When a victim is found using the snow probe, element 15 (FIG. 8) can quickly be removed from element 13 and blade 7 can be reattached to element 13 to begin digging the victim out. Otherwise, to completely collapse the snow probe, one must work backwards from the smallest diameter element to the largest diameter. When all elements are collapsed inside each other, a twisting motion between each element will align the spring pins with their respective locking apertures. When all elements are indexed within each other, aperture 14 (FIG. 3) aligns allowing spring pin 23 of blade 7 to be secured to handle 22.

To use the device as an adjustable ski pole, secondary tip 25 attaches permanently to primary tip 21. Blade 7 is removed and each element is telescoped to its outward most position. Then, snow basket 27 attaches to secondary tip 25 with a screwing motion. Then the proper length is set by retracting element 19 to an appropriate aperture in element 17. Then element 17 is retracted to an appropriate aperture in element 15. Then element 15 is retracted to an appropriate aperture in element 13. This allows the proper length of the ski pole to be set.

After using the device as a ski pole, snow basket 27 is unscrewed from secondary tip 25. Then the elements are retracted completely, beginning with the smallest diameter element. When all the elements are retracted fully, each element is twisted within the next to align the corresponding apertures with the locking spring pins to lock out or index them completely.

Accordingly, the reader will see that the apparatus of this invention is solely designed and customized for the use of skiers and snowmobilers for travel in the back country during the winter season. Furthermore, the Extreme Avalanche Shovel has the additional advantages in that:

- its high level of compactness increases its packability;
- it incorporates up to three separate tools into the handle of an avalanche shovel to increase the functions available to the user with minimal extra weight and virtually no extra space required; and
- it increases the odds of saving lives of buried victims by properly preparing snowmobilers and skiers with a few of the essential tools required for safe back country travel.

Although the description above contains many specifications, these should not be construed as limiting the scope of the invention but as merely providing illustrations of some of the presently preferred embodiments of this invention. For example, the Extreme Avalanche Shovel can be made of various alloys some of which may be aluminum, titanium, or carbon fiber. Many different means of attaching collets and tips such as welding, brazing, soldering, molding, or pressing fittings together, etc may also be incorporated into the design. Thus the scope of the invention should be determined by the appended claims and their legal equivalents, rather than by the examples given.

I claim:

1. A multi-function device used in the rescue and recovery of avalanche victims integrated into a single entity, in combination:

a telescoping handle comprised of a plurality of tubular elements capable of expanding to a maximum length greater than seven feet, or a minimum length less than two feet enabling attachment and detachment to a scoop or blade;

a scoop or blade having means of interlocking into a selected plurality of tubular elements while not interlocking into the entire said plurality of elements;

a tip fixed to the innermost element of said handle; and a grip fixed to the outermost element of said handle.

2. The tool of claim 1 further comprising means for limiting the penetration of said tip into a snow field.

3. The tool of claim 1 wherein said tip is easily adapted to penetrate a snow field to a depth greater than seven feet when said plurality is extended to its maximum length.

4. The tool of claim 1 further comprising the ability to detach said blade to facilitate means for adjusting the overall length of said plurality of tubular elements to any one of several preselected positions wherein a suitable length can be obtained for utilization as a spare ski pole.

5. The tool of claim 1 further comprising means for extending one element of said plurality of elements while said scoop or blade is attached to said plurality of elements.

6. The tool of claim 1 whereby said plurality has means of interlocking within each other in a fully extended position, or in a fully retracted position.

7. A tool for locating and recovering victims of avalanches comprising in combination:

a scoop or blade, a plurality of tubular elements arranged in a telescoping fashion, numerous elements of which plurality are attachable to said scoop or blade, and a grip fixed to one element of said plurality that is not attachable to said scoop or blade.

8. The tool of claim 7 wherein said scoop or blade comprises a locking spring pin for securing said scoop or blade on numerous elements of said plurality of tubular elements.

9. The tool of claim 7 wherein a collet is fixed to one end of numerous of said plurality of elements.

10. The tool of claim 7 wherein numerous elements of said plurality have a common aperture to accept a locking means attached to said scoop or blade.

11. A lightweight compact snow shovel comprising, in combination:

a scoop or blade;

a telescoping handle comprised of a plurality of tubular elements attachable to said scoop or blade;

a tip fixed to one end of said handle;

a grip fixed to a second end of said handle;

wherein said plurality of tubular elements are adjustable from a length of less than two feet to a length greater than seven feet.

12. The lightweight compact snow shovel of claim 11 wherein said scoop or blade possesses a broad and flat surface facilitating means of rapidly excavating mass quantities of snow and ice in an avalanche debris field.

13. The snow shovel of claim 11 wherein said scoop or blade and said telescoping handle are designed to be lightweight and compact in such a manner that it easily fits into a backpack or similar-sized cargo space thus enabling it to be easily carried during back country winter travel and exploration for survival and rescue purposes.

* * * * *